US006001791A

United States Patent [19]

Hemm et al.

[11] Patent Number: 6,001,791

[45] Date of Patent: Dec. 14, 1999

[54] PASTE-FORM WASHING-UP AGENT AND ITS MANUFACTURE

[75] Inventors: Dieter Hemm; Guenter Hellmann, both of Hiden; Klaus Wilbert, Duesseldorf, all of Germany

[73] Assignee: Henkel Kommanditgesellschaft auf Aktien, Duesseldorf, Germany

[21] Appl. No.: 08/983,373

[22] PCT Filed: Jul. 16, 1996

[86] PCT No.: PCT/EP96/03122

§ 371 Date: Feb. 3, 1998

§ 102(e) Date: Feb. 3, 1998

[87] PCT Pub. No.: WO97/04071

PCT Pub. Date: Feb. 6, 1997

[30] Foreign Application Priority Data

Jul. 19, 1995 [DE] Germany ..... 195 26 380

[51] Int. Cl.[6] ..... C11D 7/60; C11D 7/16

[52] U.S. Cl. ..... 510/221; 510/220; 510/404

[58] Field of Search ..... 510/220, 221, 510/222, 223, 370, 330, 404, 418, 507

[56] References Cited

U.S. PATENT DOCUMENTS

| | | | |
|---|---|---|---|
| 4,147,650 | 4/1979 | Sabatelli et al. | 252/103 |
| 4,511,487 | 4/1985 | Prühs et al. | 252/99 |
| 4,680,134 | 7/1987 | Heile et al. | 252/160 |
| 4,725,376 | 2/1988 | Copeland | 252/90 |
| 4,753,755 | 6/1988 | Gansser | 252/527 |
| 4,801,396 | 1/1989 | Altenschöpfer et al. | 252/99 |
| 5,019,290 | 5/1991 | Bruegge et al. | 252/135 |
| 5,061,392 | 10/1991 | Bruegge et al. | 252/135 |

FOREIGN PATENT DOCUMENTS

| | | |
|---|---|---|
| 0 118 658 | 9/1984 | European Pat. Off. . |
| 0 120 421 | 10/1984 | European Pat. Off. . |
| 0 331 370 | 9/1989 | European Pat. Off. . |
| 0 441 057 | 8/1991 | European Pat. Off. . |
| 28 10 999 | 9/1978 | Germany . |
| 31 38 425 | 4/1983 | Germany . |
| 60-186134 | 9/1985 | Japan . |
| 62-045 698 | 2/1987 | Japan . |
| 0 449 428 | 6/1936 | United Kingdom . |
| 1 320 919 | 6/1973 | United Kingdom . |

*Primary Examiner*—Yogendra Gupta
*Assistant Examiner*—Gregory E. Webb
*Attorney, Agent, or Firm*—Ernest G. Szoke; Wayne C. Jaeschke; Glenn E. J. Murphy

[57] ABSTRACT

The invention concerns a liquid agent in suspension for use in washing-up machines. The aim of the invention is to ensure the consistency of a paste without the need to use thickeners or extenders. This is achieved by using 30 to 60% by weight of water, 15 to 70% by weight of an alkali-metal tripolyphosphate selected from sodium tripolyphosphate, used either in the anhydrous or the partly hydrated form, and potassium tripolyphosphate in the presence of 5 to 30% by weight of an alkali carrier such as an alkali-metal hydroxide, carbonate, or metasilicate, if necessary in the presence of active-chlorine carriers, complex carriers and the other usual auxiliaries.

17 Claims, No Drawings

PASTE-FORM WASHING-UP AGENT AND ITS MANUFACTURE

BACKGROUND OF THE INVENTION

1. Field of the Invention

This invention relates to a paste-form water-containing dishwashing detergent in the form of a suspension of salts in a solution thereof and to its production. The dishwashing detergent according to the invention is intended to be used in particular in institutional dishwashing machines, as used inter alia in canteens, hotels and hospitals, although it may also be used for other cleaning functions.

2. Discussion of the Related Art

Thixotropic and non-thixotropic pastes have been known for years in the field in question. Thus, EP 75 813 describes a machine dishwashing detergent in the form of a thixotropic paste which has a viscosity of 70 to 200 Pas and which, in addition to polyphosphates, alumosilicates, hydroxides, silicates and carbonates of sodium, contains a thickener from the class of swellable layer silicates. This patent application is more or less directed to the use of the thickener mentioned, i.e. the swellable layer silicates, in such formulations. There are many other prior art publications in which thickener-containing dishwashing detergents are described, cf. for example the prior art discussed in EP 331 370 B1 (Unilever).

However, the use of such thickeners in paste-form, dishwashing detergents is not entirely desirable in practice. Their thickening effect apart, thickeners are expensive and otherwise usually purposeless additives which could be dispensed with on economic and possibly also ecological grounds.

Accordingly, proposals have also been put forward with a view to producing corresponding formulations without the use of thickeners.

Applicant's European patent application EP 0 118 658 A1 describes a process for the production of a paste-form detergent in which alkali metal silicates of the disilicate type are mixed in a certain ratio with alkali metal silicates of the metasilicate type to form detergents with a paste-like consistency.

Similarly, EP 331 370 B1 (Unilever) proposes starting with alkali metal silicates and modifying them by using sodium hydroxide to obtain substantially non-thixotropic pastes. Although formulations according to the two above-cited prior art publications are free from thickeners or consistency regulators, they do contain silicates as a compulsory component. Although silicates are very favorable raw materials in many respects in the field of application under discussion, they can occasionally lead to deposits when used in relatively large quantities and under adverse water hardness conditions and also under certain unfavorable dishwashing machine conditions, with the result that they are not entirely safe to use. In addition, the compounds known from the prior art undergo a rapid increase in viscosity during the production process, so that—with relatively large batches—the end products cannot readily be packed in retail containers and left to harden therein.

Japanese patent application Showa 6245698 describes liquid detergents for use in automatic dishwashing machines which contain 5 to 50% by weight of potassium carbonate, less than 5% by weight of potassium hydroxide and/or less than 5% by weight of sodium hydroxide. The teaching of this citation is based on the observation that, by adding potassium carbonate, the alkaline properties of the detergent remain intact in the event of a reduction in the alkali metal hydroxide content of the detergent. However, pastes are not described; the formulations have low viscosities.

Against the background of this prior art, the problem addressed by the present invention was to provide a detergent for institutional dishwashing machines which would be present in the form of a paste-like suspension of salts in a solution thereof, would be free from thickeners and fillers and which, during its production, would pass through a low-viscosity phase to enable the detergent to be packed in retail containers from large tanks before it solidifies to form a paste. Another problem addressed by the invention was to formulate the corresponding dishwashing detergents which would not contain silicates, such as alkali metasilicates, as a compulsory ingredient.

DESCRIPTION OF THE INVENTION

Accordingly, the present invention relates to liquid detergents in the form of a paste-like suspension for use in machine dishwashing, as a cleaner or the like, particularly in the institutional sector, based on alkali metal tripolyphosphates and an alkalinity carrier, characterized in that it contains 30 to 60% by weight of water, 15 to 70% by weight of an alkali metal tripolyphosphate selected from
- sodium tripolyphosphate used
  - either as a water-free salt and/or
  - as a partly hydrated salt or
- potassium tripolyphosphate 5 to 30% by weight of an alkalinity carrier selected from alkali metal hydroxide, alkali metal carbonate and/or alkali metasilicate and, if desired, active chlorine carriers, complexing agents and/or other typical ingredients.

The formulations according to the invention are free from effective quantities of thickeners. The invention is based on the observation that partly hydrated alkali metal tripolyphosphates, more particularly partly hydrated sodium tripolyphosphate (normally with a bound water content of 1 to 5% by weight and preferably around 3% by weight), give suspensions with a creamy paste-like consistency when added to water in a quantity above the solubility product. The invention is further based on the observation that this consistency can be shifted to higher (apparent) viscosities by the addition of water-free sodium tripolyphosphate which forms a hexahydrate when water is added. Accordingly, the inventors chose this system as a base for the paste.

According to the invention, the alkali metal tripolyphosphates are used in quantities of 15 to 70% by weight, the water-free stage used may be present in quantities of up to 40% by weight and preferably in quantities of up to 15% by weight, based on the formulation as a whole, and the partly hydrated form is used in quantities of up to 50% by weight and preferably in quantities of 15 to 30% by weight.

The phosphates mentioned may also be individually used.

The two forms of the sodium tripolyphosphate may also be partly replaced by potassium tripolyphosphate, preferably in quantities of 50 to about 70% by weight.

To enable the pastes thus produced to be used for machine dish-washing, an alkali carrier is required and should be present in 5 to 30% by weight. The alkali carrier may be selected from alkali metal hydroxides, such as sodium or potassium hydroxide, alkali metal carbonates, such as sodium carbonate, potassium carbonate in anhydrous or hydrated form, or even small quantities, i.e. 5 to 10% by weight, of alkali metal silicate, preferably in combination with the alkali carriers mentioned above.

The properties of the formulation can be influenced through the choice of the alkalinity carrier. Thus, tests have shown that sedimentation stability can be increased where sodium hydroxide is used as the alkalinity carrier.

In a first embodiment of the invention, sodium hydroxide or potassium hydroxide may be used as the alkali carrier. They are preferably used in the form of solutions, for example 30 to 60% solutions.

In another embodiment of the invention, carbonates or—if desired— hydrogen carbonates are used as the alkali carrier. However, hydrogen carbonates should always be used together with the corresponding alkali metal hydroxides. The carbonates, i.e. for example potassium carbonate, but especially sodium carbonate, are preferably used in the form of anhydrous salts, although hydrates, for example dihydrates or the decahydrate, may also be used. In this case, it is important to ensure that the upper limit to the water content is at least not significantly exceeded.

Although not quite so preferred, alkali metal silicates may also be used as the alkali carrier. Thus, alkali metal silicates with an $Na_2O:SiO_2$ ratio (modulus) of 0.5 to 2.5:1 and a water content of 10 to 50% by weight may be used in certain quantities if desired, for example in quantities of 5 to 25% by weight. However, since disilicates make only a small contribution to alkalinity, it is preferred to use alkali metasilicates, for example alkali metasilicate solutions with an $Na_2O:SiO_2:H_2O$ ratio of 1:1:0 to 5 or the corresponding potassium compounds. Since the silicates are not particularly preferred compounds in the context of the teaching according to the invention, the quantities used should be limited and, preferably, should not exceed 20% by weight and, more particularly, 15% by weight. If they are used at all, 5% by weight is a sensible lower limit.

The detergents according to the invention may additionally contain an active chlorine carrier. Preferred active chlorine compounds are sodium, potassium or lithium hypochlorite. Chlorinated trisodium- or tripotassium-o-phosphate are also useful compounds. Organic chlorine carriers, such as trichloroisocyanuric acid or alkali metal dichloroisocyanurates or N-chlorinated sulfamides or triazines, are less preferred because they are not stable in storage in liquid or paste-form detergent formulations. The quantity in which the chlorine carrier is used is preferably gauged in such a way that the detergents according to the invention contain 0.1 to 2.5% by weight and, more particularly, 0.5 to 1.0% by weight of active chlorine.

Other optional ingredients are low-foaming nonionic surfactants which do not decompose in the presence of active chlorine compounds and optionally alkali metal hydroxides. The low-foaming nonionic surfactants used are preferably ethylene oxide adducts with relatively high molecular weight polypropylene glycols (molecular weight 900 to 4,000) and adducts of ethylene oxide or ethylene oxide and propylene oxide with higher fatty alcohols, such as dodecyl alcohol, palmityl alcohol, stearyl alcohol, oleyl alcohol or mixtures thereof and synthetic alcohols, for example produced by oxosynthesis, with chain lengths of $C_{12}$ to $C_{18}$ and corresponding alkylene oxide adducts with alkylphenols, preferably nonylphenol. Examples of suitable addition products are the adduct of 10 to 30% by weight of ethylene oxide with a polypropylene glycol having a molecular weight of 1,750, the adduct of 20 moles of ethylene oxide or 9 moles of ethylene oxide and 10 moles of propylene oxide with nonylphenol, the adduct of 5 to 12 moles of ethylene oxide with a $C_{12-18}$ fatty alcohol mixture containing around 30% of oleyl alcohol and the like. This list of examples is not meant to be limiting in any way. The percentage content of nonionic surfactants may be up to 5% by weight and is preferably from 0.1 to 1% by weight.

If desired, chlorine-stable and alkali-stable dyes and fragrances may be added to the dishwashing detergents.

Other suitable additives are organic complexing agents which are resistant to active chlorine. Additives such as these are generally nitrogen-free complexing agents, for example polyfunctional phosphonic acids, such as methylene diphosphonic acid, and polyfunctional phosphonocarboxylic acids, such as 1,1-diphosphonopropane-1,2-dicarboxylic acid, 1-phosphonopropane-1,2,3-tricarboxylic acid or 2-phosphonobutane-2,3,4-tricarboxylic acid, and sodium or potassium salts thereof. Other suitable complexing agents are the active-chlorine-stable polycarboxylic acids and their salts.

The detergents according to the invention may also contain enzymes. However, if enzymes are used, it is important not to add active chlorine carriers. Suitable enzymes are, in particular, amylases, although proteases and optionally lipases may also be used. It is well known that, to maintain enzyme activity in storage, enzyme stabilizers often have to be used. Suitable enzyme stabilizers are, for example, salts of boric acid or sulfurous acid and salts of polybasic organic carboxylic acids.

In another embodiment of the invention, up to 10% by weight of the sodium or potassium tripolyphosphates may be replaced by the fine-particle zeolites typically encountered in detergents, for example zeolite A, zeolite B or zeolite MAP.

The viscosity of the detergents according to the invention is established through the solids content and through the quantity of tripolyphosphate anhydride in such a way that firm pastes are formed. Firm pastes are understood to be pastes which will not flow out from the retail container should it be accidentally turned upside down or tilted.

Using a Brookfield Model DV-II viscosimeter with a spindle corresponding to the particular viscosity, a viscosity of 50 to 800 Pas was determined after a running time at 5 r.p.m. of 165 to 180 seconds.

The production of the liquid detergents according to the invention is unproblematical. Normally, water is introduced first and the alkali metal tripolyphosphate (anhydrous and/or in partly hydrated form) is subsequently added. Under the effect of the exothermic hydration reaction, the reaction mixture heats up, the alkali carrier is added and, if desired, the reaction mixture is cooled to room temperature or lower where it is intended to add an active chlorine carrier. The remaining ingredients are then added and the formulation may be packed in transportation and storage containers because an increase in the viscosity of the originally very thin mixture only begins after 30 minutes to a few hours. So far as the practical production of the formulations is concerned, this slow increase in viscosity represents a distinct advantage over the prior art.

In another preferred embodiment, the water is introduced first and alkali carrier is stirred in, after which the tripolyphosphate is added in hydrated or water-free form. After stirring, for example for 30 to 60 minutes, an organic chlorine carrier is optionally introduced into the still liquid mixture at around 30° C. In this case, too, the mixture obtained remains free-flowing for up to several hours during which it can be packed in a retail container. Only thereafter does the detergent composition gradually harden into an almost solid block. The hardening rate and the final consistency are always determined by the tripolyphosphate and sodium hydroxide contents. Generally speaking, it may be said that more tripolyphosphate produces a firmer consistency, although this is not meant to limit the invention in any way.

It is unfavorable to add water-free tripolyphosphate to water because, in this case, the mixture as a whole is in danger of hardening completely in just a few minutes.

EXAMPLES

Example 1

A paste-form detergent was prepared from (in % by weight):

15% by weight of pentasodium tripolyphosphate (used as a partly hydrated product containing about 3% of water, Thermophos NW)

10% by weight of pentasodium tripolyphosphate hydride (Thermophos N)

20% by weight of sodium carbonate (anhydride)

10% by weight of sodium hydroxide, 50%

5% by weight of chlorine bleach liquor (corresponding to 1.2% of active chlorine)

water to 100.

To prepare the paste, the water was introduced first, after which first the soda, then the sodium hydroxide and thereafter the two tripolyphosphates were added, followed after cooling to room temperature by addition of the chlorine bleach liquor. A suspension was obtained, solidifying after about 60 minutes to form a viscous paste. After loading into the automatic dispenser of an institutional dishwashing machine, none of the product flowed out uncontrollably from a 5 kg drum with a 10 cm diameter opening in its cover.

The degree of retention of the tripolyphosphate measured after 1 month was within the usual limits (tripolyphosphate: degree of retention ca. 95%).

Example 2

A paste-form detergent was prepared from (in % by weight):

25% by weight of pentasodium tripolyphosphate (used as a partly hydrated product containing about 3% of water, Thermophos NW)

20% by weight of pentasodium tripolyphosphate hydride (Thermophos N)

10% by weight of sodium carbonate (anhydride)

5% by weight of chlorine bleach liquor (corresponding to 1.2% of active chlorine)

water to 100.

The formulations produced good to excellent cleaning results in an institutional single-tank dishwashing machine.

Comparison Example according to Japanese application Showa 62-45698

Title: Liquid dishwashing detergents

Application number: Showa 60-186134

Filing date: 23.08.1985

Publication date: 27.02.1987

Example 11 was reproduced:

| Ingredient | |
|---|---|
| NaOH (49% solution) | 5.0 |
| KOH (48% solution) | 10.0 |

-continued

| Ingredient | |
|---|---|
| K carbonate (anhydr.) | 20.0 |
| Na tripolyphosphate (anhydr.) | 10.0 |
| K pyrophosphate (anhydr.) | — |
| NTA-Na (monohydrate) | 3.0 |
| Na hypochlorite (13% solution) | — |
| water | 52.0 |

A water-thin formulation which did not meet the requirements for a paste was obtained.

We claim:

1. A process for the production of a paste-like detergent suspension comprising the steps of combining 30% to 60% by weight of water with 15% to 70% by weight of sodium tripolyphosphate, wherein the sodium tripolyphosphate is comprised of 15% to 50% by weight of partly hydrated sodium tripolyphosphate and 0 to 40% by weight of anhydrous sodium tripolyphosphate, and 5% to 30% by weight of an alkalinity carrier selected from the group consisting of alkali metal hydroxides, alkali metal carbonates, alkali metal metasilicates, and mixtures thereof, said weight percents based on the weight of the suspension, wherein the sodium tripolyphosphate is combined with the water immediately before or after the alkalinity carrier is combined with the water, such that the suspension remains free flowing for at least 30 minutes after the water, tripolyphosphate, and alkalinity carrier are combined.

2. A process according to claim 1, wherein the sodium tripolyphosphate is comprised of 0 to 15% by weight of anhydrous sodium tripolyphosphate.

3. A process according to claim 1, wherein the sodium tripolyphosphate is comprised of 15% to 30% by weight of partly hydrated sodium tripolyphosphate.

4. A process according to claim 1, wherein the partly hydrated sodium tripolyphosphate has a bound water content of 1% to 5% by weight, based on the weight of the partly hydrated sodium tripolyphosphate.

5. A process according to claim 4, wherein the partly hydrated sodium tripolyphosphate has a bound water content of 3% by weight.

6. A process according to claim 1, wherein the alkalinity carrier is sodium hydroxide or potassium hydroxide in the form of a 30% to 60% by weight aqueous solution.

7. A process according to claim 1, comprising combining the water and sodium tripolyphosphate in powder form to form a reaction mixture that is heated by an exothermic hydration reaction between the water and tripolyphosphate, adding to the reaction mixture the alkalinity carrier, cooling the reaction mixture to room temperature or below, and adding to the cooled reaction mixture an amount of an active chlorine carrier selected from the group consisting of alkali metal hypochlorites, chlorinated alkali metal phosphates, organic chlorine carriers, and mixtures thereof, such that the suspension contains 0.1% to 2.5% by weight of active chlorine.

8. A process according to claim 7, wherein the suspension contains 0.5% to 1.0% active chlorine.

9. A process according to claim 1, comprising combining the water and the alkalinity carrier to form a reaction mixture, adding to the reaction mixture the sodium tripolyphosphate followed by stirring for 0 to 180 minutes, and next adding an active chlorine carrier selected from the group consisting of alkali metal hypochlorites, chlorinated alkali metal phosphates, organic chlorine carriers, and mixtures thereof, such that the suspension contains 0.1% to 2.5% by weight of active chlorine.

10. A process according to claim 9, wherein the reaction mixture is stirred for 30 to 60 minutes at 30° C. after addition of the tripolyphosphate, and the suspension contains 0.5% to 1.0% active chlorine.

11. A process according to claim 1, wherein the alkalinity carrier is selected from the group consisting of sodium carbonate, sodium hydroxide, potassium hydroxide, and alkali metal metasilicates.

12. A process according to claim 11, wherein sodium metasilicate is used as the alkalinity carrier in an amount that leads to a suspension comprising 5% to 15% by weight of sodium metasilicate.

13. A process according to claim 7, wherein the active chlorine carrier is selected from the group consisting of sodium hypochlorite, potassium hypochlorite, lithium hypochlorite, chlorinated trisodium-o-phosphate, chlorinated tripotassium-o-phosphate, trichloroisocyanuric acid, alkali metal dichloroisocyanurates, N-chlorinated sulfamides, N-chlorinated triazines, and mixtures thereof.

14. A process according to claim 8, wherein the active chlorine carrier is selected from the group consisting of sodium hypochlorite, potassium hypochlorite, lithium hypochlorite, chlorinated trisodium-o-phosphate, chlorinated tripotassium-o-phosphate, trichloroisocyanuric acid, alkali metal dichloroisocyanurates, N-chlorinated sulfamides, N-chlorinated triazines, and mixtures thereof.

15. A process according to claim 9, wherein the active chlorine carrier is selected from the group consisting of sodium hypochlorite, potassium hypochlorite, lithium hypochlorite, chlorinated trisodium-o-phosphate, chlorinated tripotassium-o-phosphate, trichloroisocyanuric acid, alkali metal dichloroisocyanurates, N-chlorinated sulfamides, N-chlorinated triazines, and mixtures thereof.

16. A process according to claim 10, wherein the active chlorine carrier is selected from the group consisting of sodium hypochlorite, potassium hypochlorite, lithium hypochlorite, chlorinated trisodium-o-phosphate, chlorinated tripotassium-o-phosphate, trichloroisocyanuric acid, alkali metal dichloroisocyanurates, N-chlorinated sulfamides, N-chlorinated triazines, and mixtures thereof.

17. A process according to claim 10, wherein the suspension remains free flowing at 30° C. for at least 30 minutes after the water, tripolyphosphate, and alkalinity carrier are combined.

* * * * *